United States Patent [19]

Deutsch

[11] Patent Number: 4,489,637

[45] Date of Patent: Dec. 25, 1984

[54] PERCUSSIVE VOICE GENERATOR FOR AN ELECTRONIC MUSICAL INSTRUMENT

[75] Inventor: Ralph Deutsch, Sherman Oaks, Calif.

[73] Assignee: Kawai Musical Instruments Mfg. Co., Ltd, Hamamatsu, Japan

[21] Appl. No.: 422,809

[22] Filed: Sep. 24, 1982

[51] Int. Cl.[3] ..... G10H 1/06

[52] U.S. Cl. ..... 84/1.22; 84/1.01

[58] Field of Search ..... 84/1.19, 1.22, 1.23, 84/1.01

[56] References Cited

U.S. PATENT DOCUMENTS 3,913,442 10/1975 Deutsch ..... 84/1.19

4,122,742 10/1978 Deutsch ..... 84/1.19

4,205,577 6/1980 Deutsch ..... 84/1.22

*Primary Examiner*—Forester W. Isen

*Attorney, Agent, or Firm*—Ralph Deutsch

[57] ABSTRACT

A keyboard operated electronic musical instrument in which a number of tone generators are assigned to actuated keyswitches in which a combination of a transient voice and a steady state tone is generated by implementing a discrete Fourier transform employing a selected sequence of harmonic coefficients. A harmonic sequence select logic in cooperation with signals from actuated tone switches provide the selected sequence of harmonic coefficients. A percussion coefficient is added to the sequence of harmonic coefficients in response to a percussion control signal. Various playing modes are disclosed. In one mode the transient voice is generated with the actuation of the first keyswitch on a selected keyboard, and other subsequent actuations are ignored. In a second mode, a transient voice is actuated if at the time of a keyswitch actuation no other transient voice is being generated.

11 Claims, 14 Drawing Figures

16-FOOT

8-FOOT 5 1/3-FOOT

4-FOOT 2 2/3-FOOT

FUNDAMENTAL PITCHES

TOTAL FLUTE SPECTRA 2
4
6
8
10
12
14

PERCUSSIVE VOICE GENERATOR FOR AN ELECTRONIC MUSICAL INSTRUMENT

BACKGROUND OF THE INVENTION

1. Field of the Invention

This invention relates to electronic musical tone synthesis and in particular is concerned with the generation of tones that have a percussive transient at the start of the tone.

2. Description of the Prior Art

A feature commonly used with electronic keyboard instruments intended for producing popular music is one that is given the generic name of "percussive voice". This is usually a composite voice including a first tone having a piano-like ADSR (attack/decay/sustain/release) envelope played in combination with an organ-like sustained tone. The musical effect is a transient percussive sound at the onset of tonal production.

In U.S. Pat. No. 3,740,450 entitled "Apparatus And Method For Simulating Chiff" a system is described for producing chiff tones in a digital organ of the type wherein a musical waveshape is repetitively read out of storage at a rate related to the selected note. A chiffing waveshape is stored in a separate memory that is accessed during the attack portion of the primary tone. The separate waveshape memory outputs are combined to produce the chiffed musical tone.

In U.S. Pat. No. 3,913,422 entitled "Voicing For A Computer Organ" a system is described for producing chiff tones (otherwise called transient or percussive tones) in an organ of the type described in U.S. Pat. No. 3,809,786. In this system, musical tones are produced by computing in real time the amplitudes x(gR) at successive sample points gR of a musical waveshape and converting these amplitudes to musical tones as the computations are carried out. The tonal quality of the generated note is established by a set of harmonic coefficients. Transient voices are obtained by adding selected harmonics to the set of harmonic coefficients for a short interval at the onset of the generated waveshape.

In U.S. Pat. No. 4,122,742 entitled "Transient Voice Generator" a polyphonic system is described for producing musical tones having a time variant change by computing master and transient data sets, transferring these data to buffer memories, adding the data read out from the buffer memories briefly during a transient time interval and repetitively converting the summed data to waveforms. The master and transient data set are created repetitively and independently of tone generation by computing a generalized Fourier algorithm using stored sets of Generalized Fourier coefficients.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created by implementing a discrete Fourier transform using a select logic which characterizes the selected output musical sounds or tones. At the end of each one of the sequence of computation cycles, the computed master data set is stored in a main register. The computations are carried out at a fast rate which may be nonsynchronous with any musical frequency.

Following each computation cycle, a transfer cycle is initiated during which the stored master data set is transferred from the main register to preselected members of a multiplicity of tone generators and stored in a note register which is an element of each of the individual tone generators. The output tone generation continues uninterrupted during the computation and transfer cycles.

The select logic performs a combination of system functions. A full set of unified tone pitches is generated by means of a select logic which employs a time shared set of a minimum number of stored harmonic coefficients. The particular harmonic coefficients are chosen in response to the setting of a number of tone switches. The percussive voice is added to the attack time of a generated tone by adding a preselected harmonic coefficient value to the harmonic coefficients chosen in response to the actuation of the tone switches.

It is an object of the present invention to simultaneously generate a set of unified tones from a minimal set of stored constant values that are time shared and to selectively add a percussive transient tone during the attack phase of a tone.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a tone generator in which a set of unified tones is generated by time sharing a minimal set of stored constants and in which a percussive tone is introduced during the attack, or tone onset, phase of the generated tones. The percussive voice generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all the elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer to implement the improvements of the present invention or correspond to combinations of several elements appearing in the referenced patent.

Percussive voices are frequently added to flute tones which are characterized by having only a few prominent harmonics. This is true for the commonly used flute tone of the tibia class. A flute tibia usually has only two strong harmonic components. The first harmonic is the strongest component and the third harmonic is generally about 20 db less in power in relation to the fundamental, or first harmonic. A typical small organ tonal design may incorporate a flute chorus selected from stops, or tone switches, controlling pitches of 16-foot, 5⅓-foot, 8-foot, 4-foot and 2⅔-foot. The relation of the harmonics for the various pitches are shown in the spectra illustrated in FIGS. 1–5.

Figures 1, 2, 3, 4, 5, 6, 7:
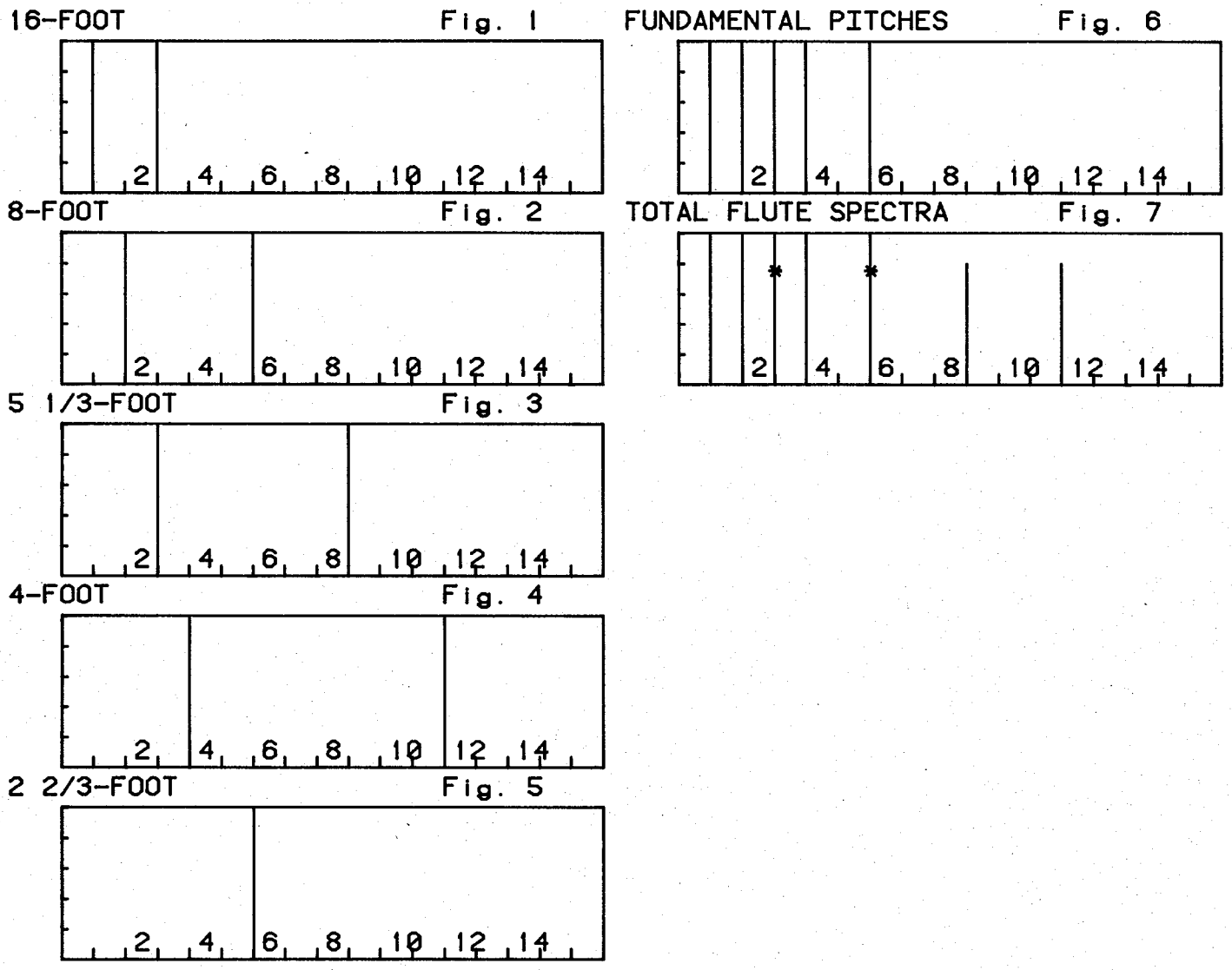
FIG. 1 is the spectra of a 16-foot flute tibia.
FIG. 2 is the spectra of an 8-foot flute tibia.
FIG. 3 is the spectra of a $5\frac{1}{3}$-foot flute tibia.
FIG. 4 is the spectra of a 4-foot flute tibia.
FIG. 5 is the spectra of a $2\frac{2}{3}$-foot flute tibia.
FIG. 6 is the spectra of the fundamental tones.
FIG. 7 is the combined spectra for a tibia flute chorus.

FIG. 6 illustrates the spectra for only the fundamentals of each member of the flute chorus. FIG. 7 illustrates the combined spectra for the flute chorus. It is noted that only two additional harmonics, the 9th and 12th, are required in addition to the five fundamental harmonics of the 16-foot harmonic sequence. Moreover the 3rd and 6th harmonics, which are marked by an asterisk, are used both as a fundamental as well as a third harmonic for an associated footage of 16-foot pitch and 8-foot pitch respectively. Thus it is observed that the entire flute chorus only requires a capability of employing seven harmonics.

Figure 8:
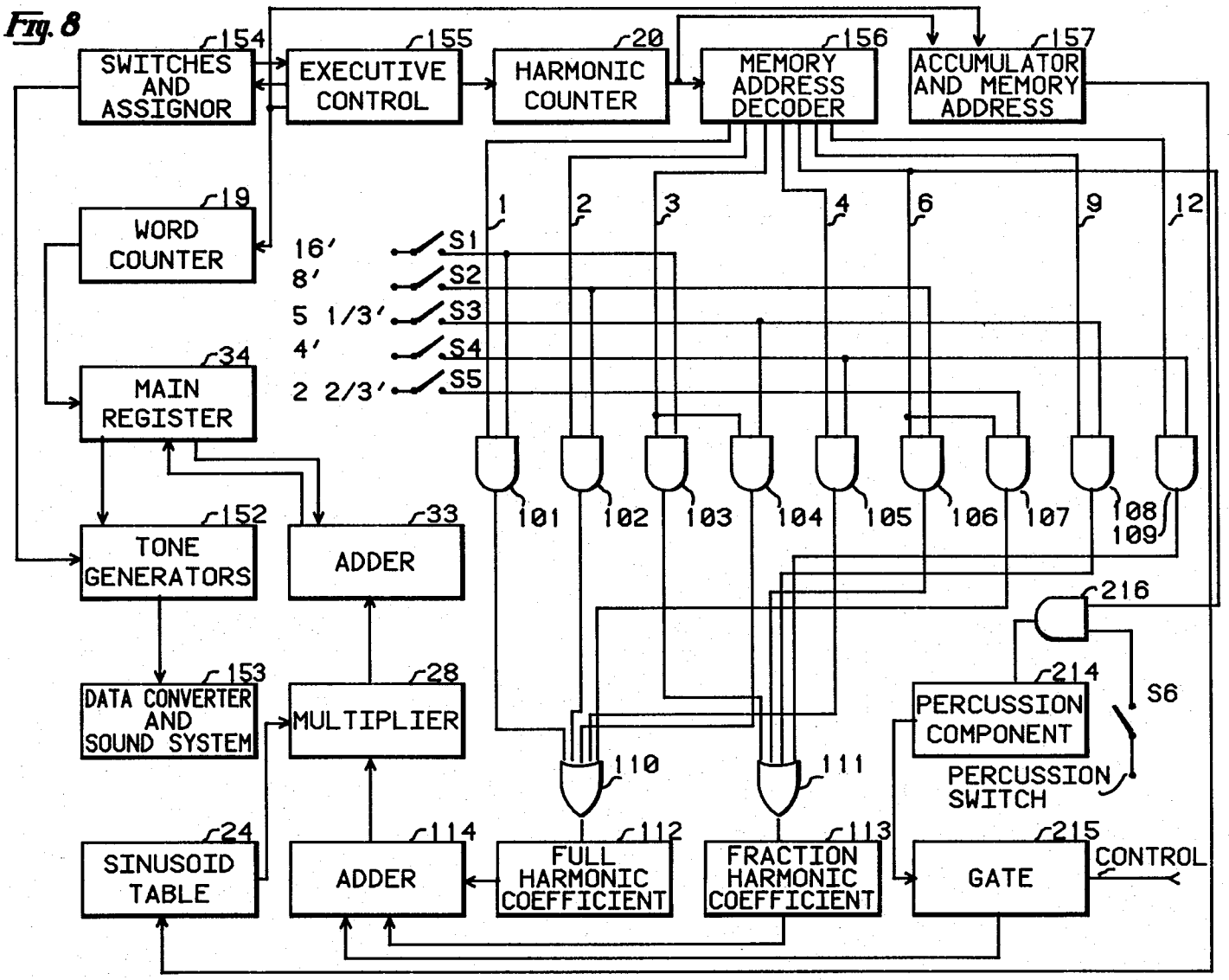
FIG. 8 is a schematic diagram of an embodiment of the invention.

FIG. 8 shows an embodiment of the present invention which is described as a modification and adjunct to the system described in U.S. Pat. No. 4,085,644. The operation of the basic flute chorus generator is described in the copending patent application Ser. No. 06/411,159 filed Aug. 24, 1982 entitled A Flute Chorus Generator For A Polyphonic Tone Synthesizer. This application has the same inventor as the present invention and both are assigned to the same assignee.

As described in the referenced patent, the Polyphonic Tone Synthesizer includes an array of keyboard switches. The array is contained in the system block labeled switches and assignor 154 which, for example, correspond to the conventional keyboard linear array of switches for an electronic musical instrument such as an organ. If one or more instrument keys have a switch status change and are actuated ("on" position) on the instrument's keyboard, a note detect and assignor circuit, which is a component of the system block labeled switches and assignor 154, stores the corresponding note information for the actuated keyswitches and one member of the set of tone generators 152 is assigned to each actuated keyswitch. A suitable note detect and assignor subsystem is described in U.S. Pat. No. 4,022,098 which is hereby incorporated by reference.

When one or more keyswitches on the keyboards have been actuated, the executive control 155 initiates a sequence of computation cycles. During each computation cycle, a master data set consisting of 32 data words is computed in a manner described below and stored in the main register 34. The 32 data words in the master data set are generated using the harmonic coefficients furnished to the adder 114 in response to the switch status of the tone switches, or stops, S1-S5 and the percussion switch S6. The 32 data words in the master data set correspond to the amplitudes of 32 equally spaced points of one cycle of the audio waveform for the musical tone produced by the tone generators 152. The general rule is that the maximum number of harmonics in the audio tone spectra is no more than one half of the number of data points in one complete waveshape period. Therefore, a master data set comprising 32 data words corresponds to a maximum of 16 harmonics which suffices to generate a flute chorus.

At the completion of each computation cycle in the sequence of computation cycles, a transfer cycle is initiated during which the master data set residing in the main register 34 is transferred to note registers which are elements of each member of the set of tone generators contained in the system block labeled tone generators 152. These note registers store the 32 data words which correspond to one complete cycle of a preselected musical tone corresponding to the switch states of the tone switches S1-S6. The data words stored in the note registers are read out sequentially and repetitively and transferred to a digital-to-analog converter which converts the digital data words into an analog musical waveshape. The digital-to-analog converter is contained in the system block labeled data conversion and sound system 153. The musical waveshape is transformed into an audible sound by means of a sound system consisting of a conventional amplifier and speaker subsystem which are also contained in the system block labeled data conversion and sound system 153. The stored data is read out of each note register at an address advance rate corresponding to the fundamental frequency of the note corresponding to the actuated keyswitch to which a tone generator has been assigned.

As described in the referenced U.S. Pat. No. 4,085,644 it is desirable to be able to continuously recompute and store the generated master data set during a sequence of computation cycles and to load this data into the note registers while the actuated keys remain depressed on the keyboards. This system function is accomplished without interrupting the flow of data points to the digital-to-analog converter at the read-out clock rates.

In the manner described in the referenced U.S. Pat. No. 4,085,644 the harmonic counter 20 is initialized at the start of each computation cycle. Each time that the word counter 19 is incremented so that it returns to its initial state because of its modulo counting implementation a signal is provided which increments the count state of the harmonic counter 20. The word counter 19 is implemented to count modulo 32 which is the number of data words in the master data set which is generated and stored in the main register 34. The harmonic counter 20 is implemented to count modulo 16. This number corresponds to the maximum number of harmonics consistent with a master data set comprising 32 data words.

At the start of each computation cycle, the contents of the accumulator contained in the accumulator and memory address 157 is initialized to a zero value. Each time that the word counter 19 is reset to its initial value, the accumulator is reset to a zero value. Each time that the word counter 19 is incremented, the accumulator adds the current count state of the harmonic counter 20 to the sum contained in the accumulator.

The content of the accumulator in the accumulator and memory address 157 is used to address out sinusoid values from the sinusoid table 24. The sinusoid table 24 is implemented as a read only memory storing values of the trigonometric function sin $(2\pi\phi/32)$ for $0 \leqq \phi \leqq 32$ at intervals of D where D is a resolution constant.

The trigonometric values read out from the sinusoid table 24 are provided as one of the input data values to the multiplier 28.

The memory address decoder 156 decodes the binary count states of the harmonic counter 20 into a time sequence of decimal integer states which are outputs on the seven lines shown in FIG. 8. Only the designated seven count states are used in the harmonic select logic and the remaining count states of the harmonic counter 20 are ignored by the memory address decoder 156. The seven lines are called harmonic select signal lines.

The array of AND-gates 101–109 are used to select elements of the time sequence of harmonic signals present on the seven output signal lines from the memory address decoder 156 in response to the actuation of the five tone switches S1-S5. For example, suppose that the 16-foot tone switch S1 is closed ("on" actuated position). In this case the AND-gate 101 will transfer the first harmonic signal to the OR-gate 110 and the third harmonic signal will be transferred, when it occurs at a later time, to the OR-gate 111 via AND-gate 103.

The set of AND-gates 101–109 and the two OR-gates 110 and 111 serve to provide the select signals corresponding to the harmonic spectra curves shown in FIGS. 1–7.

The zero db harmonic coefficient constant is stored in the full harmonic coefficient 112. The −20 db harmonic coefficient constant is stored in the fraction harmonic coefficient 113. These constants are selected and then transferred to the adder 114 in response to the signals provided by the OR-gates 110 and 111. The output of the adder 114 is furnished as the second data input to the multiplier 28.

The contents of the main register 34 are initialized at the start of a computation cycle. Each time that the word counter 19 is incremented, the contents of the main register 34 at an address corresponding to the count state of the word counter 19 is read out and furnished as one input to the adder 33. The sum of the inputs to the adder 33 are stored in the main register 34 at a memory location equal, or corresponding, to the count state of the word counter 19.

After the word counter 19 has been cycled for 16 complete count cycles of 32 counts, the main register 34 will contain the master data set having a waveshape corresponding to the actuation of the tone switches S1-S6.

Since only seven harmonics are required to generate any combination of the five voices comprising a tibia-flute chorus, a time saving can be obtained by an appropriate implementation of the harmonic counter 20. One implementation is to use the technique of inhibiting count states so that only the states corresponding to the decimal integers 1,2,3,4,6,9, and 12 can exist. All the other states are eliminated by logic gates. An alternative implementation is to have the harmonic counter designed to count modulo 7. The count state is then used to address a memory storing constants so that the number sequence 1,2,3,4,6,9,12 is read out in response to the count state of the harmonic counter. This number sequence serves as the data input to the memory address decoder 156 and the accumulator and memory address 157. If one of these limited harmonic sequences are used, then the word counter 19 counts only seven complete cycles during a computation time cycle.

The percussive voice generator is actuated by closing the percussive switch S6 which provides one of the input logic signals to the AND-gate 216. The percussive voice is commonly chosen to be a 2⅔-foot flute. Thus the second input to the AND-gate 216 is the harmonic select line from the memory address decoder 156 which has the line label 6. The system is easily modified if other pitches are desired to implement the percussive voice. The percussive, or transient, voice can also be readily implemented to be a combination of selected pitches.

The logic "1" state output from the AND-gate 216 will address out a fixed percussive harmonic coefficient from the system block labeled percussion component 214. If the CONTROL signal input to the gate 215 is in a binary logic state "1", then the percussive harmonic coefficient addressed out from the percussion component 114 is transferred as one of the input signals to the adder 114.

Figure 9:
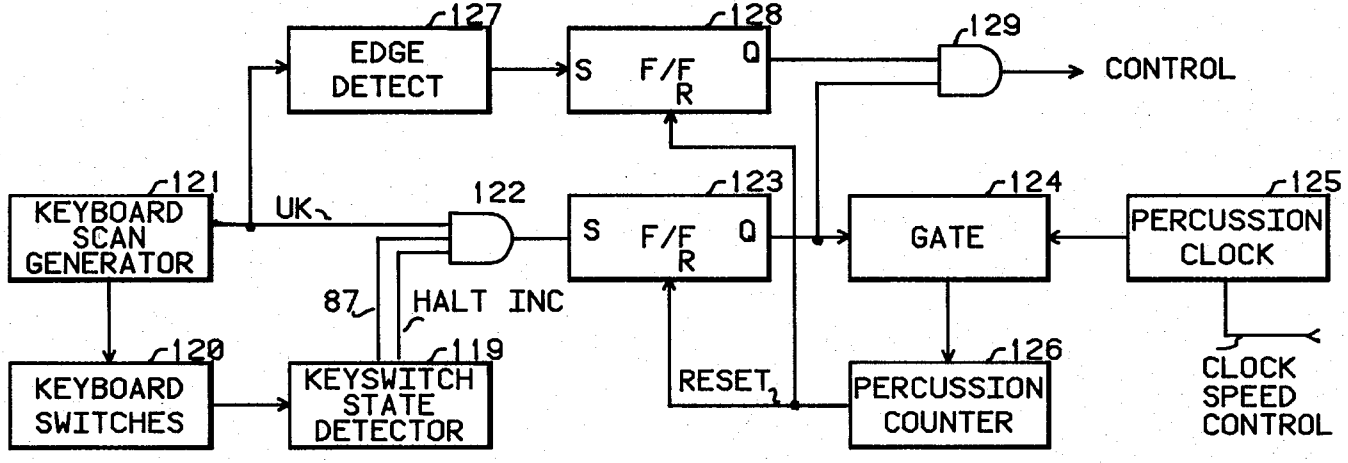
FIG. 9 is a schematic diagram of the CONTROL signal generator.

There are several alternative modes for generating the CONTROL signal which controls the addition of the percussive voice to the tone generation system previously described. One mode is implemented as shown in FIG. 9. In the first percussive system mode, the first keyboard switch that is actuated on the instrument's keyboard will initiate the percussive voice. The percussive voice will sound for a fixed predetermined time interval after which the percussive voice is automatically inhibited without affecting the remainder of the tone generation system. In the first percussive system mode, a percussive voice cannot be reinitiated unless all the keyswitches on the keyboard have been released (unactuated) for a short instant.

A second percussive system mode is one in which an independent percussive voice is added to each note as it is keyed by actuating a keyswitch on the keyboard.

In FIG. 9 the keyboard scan generator 121 generates scan signals which are applied to the array of keyboard switches in the manner described in the previously referenced U.S. Pat. No. 4,022,098. The keyboard scan generator 121 and the array of keyboard switches are contained within a system block shown in FIG. 8 and which is labeled switches and assignor 154.

The keyboard scan generator 121 generates a UK signal when the scan signals are applied to the keyswitches associated with the upper keyboard. For illustrative purposes, the CONTROL signal generation is described for the upper keyboard. It is an immediate extension to apply similar signal generation logic to any desired number of keyboards.

The keyswitch state detector 119, in the manner described in U.S. Pat. No. 4,022,098 will generate a logic "1" signal on line 87 if a keyswitch is detected to be actuated on the current keyboard scan but was not actuated on an immediate prior scan of the keyboard switches. The HALT INC signal is placed in a binary "1" logic state each time that a keyswitch is found in an actuated state during a keyboard scan.

The output logic state of the AND-gate 122 will be a "1" if a new actuated switch is detected on the upper keyboard. A logic "1" state from the AND-gate 122 will set the flip-flop 123. The UK signal is converted to a pulse-like signal by the edge detect 127 and is used to set the flip-flop 128. When both the flip-flop 123 and the flip-flop 128 are set, the AND-gate 129 creates the CONTROL signal which is used to generate the percussive voice in the manner previously described.

While flip-flop 123 is set, the gate 124 allows timing signals from the percussion counter 125 to be transferred to increment the count states of the percussion counter 126. When the percussion counter 126 reaches its maximum count state it generates a RESET signal and then, because of its modulo counting implementation, returns to its initial count state.

The RESET signal created by the percussion counter 126 is used to reset both the flip-flop 123 and the flip-flop 128. The result is that the RESET signal places the CONTROL signal in a binary logic "0" state.

The net action is that the CONTROL signal is generated in response to the first newly actuated keyswitch on the upper keyboard. Until the percussive voice has completed its time duration, no new percussive voice can be initiated even if other newly actuated keys are detected on the upper keyboard.

The length of time that the percussive voice is generated depends jointly on the clock speed of the percussion clock 125 and the modulo number for which the percussion counter 126 is implemented. The frequency of the percussion clock can be varied by using a variable speed clock whose frequency is determined by a clock speed control signal. A nominal time for the transient tone is about 0.03 seconds.

Figure 10:
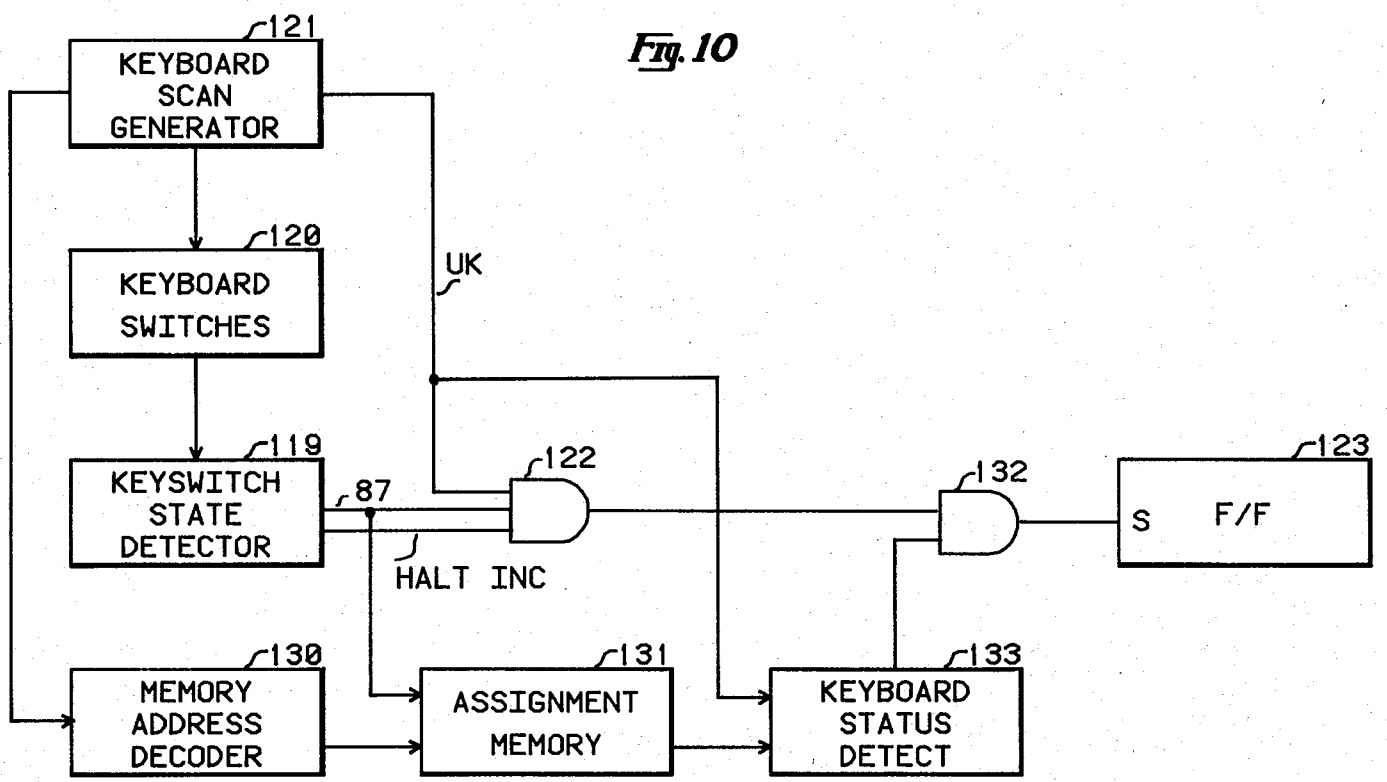
FIG. 10 is an alternate embodiment of the CONTROL signal generator.

FIG. 10 illustrates an alternate variation of the CONTROL signal generator previously shown in FIG. 9. In the first version of the mode one system, if a chord is played and if any of the keys are lifted and reactuated, then the percussive voice will again be actuated for all the notes in the chord. The system shown in FIG. 10 provides additional logic so that the percussive voice is only generated when no prior keys remain actuated and if any new keyswitch is actuated. The modified subsystem includes the keyboard status detect 133. The keyboard status detect 133 examines all the note assignment data stored in the assignment memory and which is read out by means of the memory address decoder. The data stored in the assignment memory consists of a composite data word which specifies if a particular note generation has been assigned to an actuated keyswitch, the keyboard division in which the assignment has been made, the octave number, and the musical note within the octave. The keyboard status detect 133 generates an output binary logic state "1" if no keyswitches on the upper keyboard are currently assigned. The net result is that the flip-flop 123 cannot be reset as long as any keyswitches remain actuated on the upper keyboard. Only the first detected newly actuated keyswitch signal will set the flip-flop 123 if all other keyswitches on the upper keyboard are in the nonactuated state.

Figure 11:
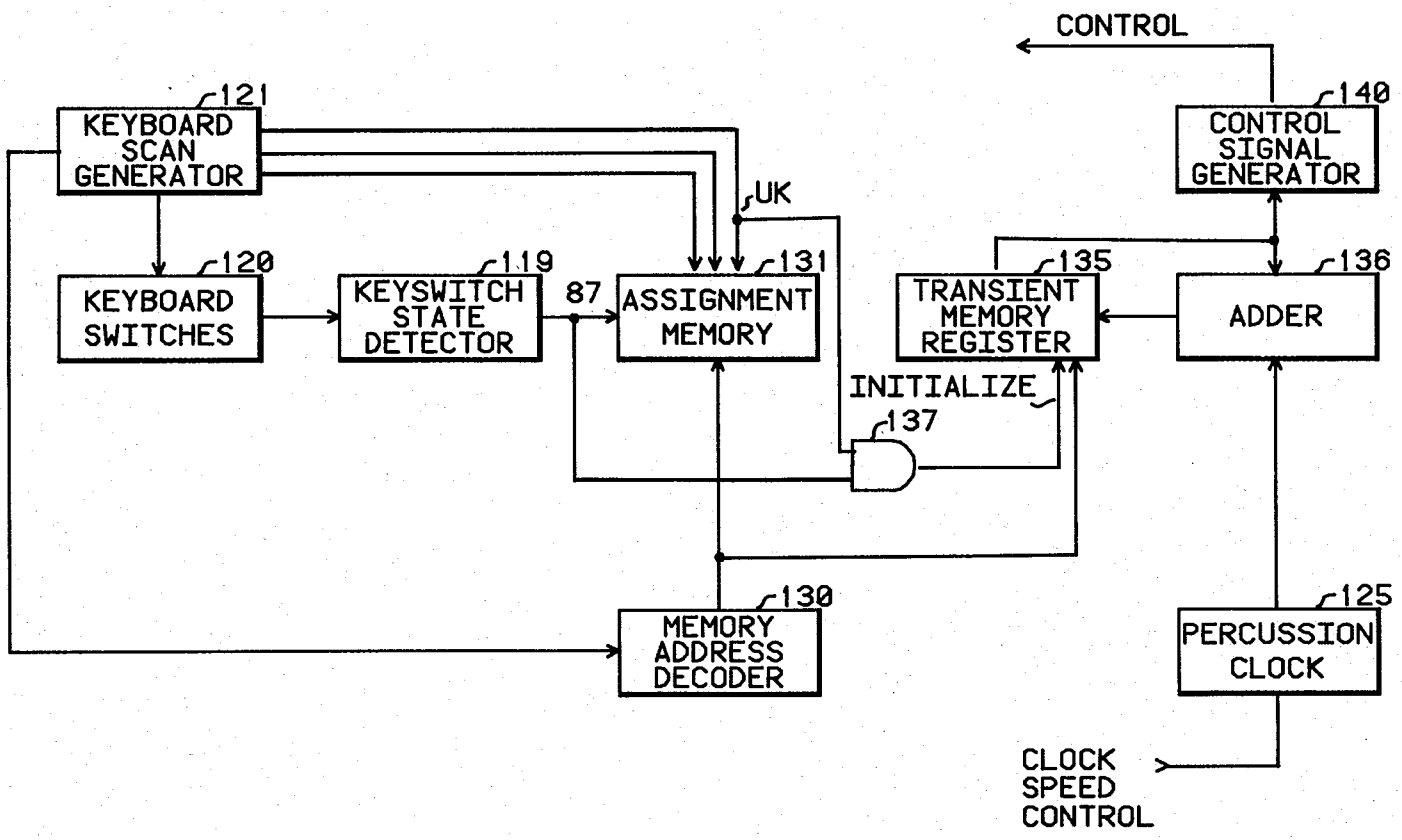
FIG. 11 is a further alternate embodiment of the CONTROL signal generator.

FIG. 11 shows the system logic for creating the CONTROL signal for the mode two percussive system operation. In the mode two operation, each newly actuated keyboard switch causes the generation of its own independent percussive voice.

The output binary logic state from the AND-gate 137 will be "1" if a newly actuated keyswitch is detected on the upper keyboard. In response to a 37 1" signal from the AND-gate 137, a data word stored in the transient memory register 135 corresponding to the output from the memory address decoder 130 is initialized to a zero value if the current value of this word is already at its maximum preselected value.

As each stored data value is read out from the transient memory register 135 in synchronism with the output address data provided by the memory address decoder 130, it is incremented by one unit if at the same time a percussion clock signal is also presented to the adder 136. The percussion clock signal is generated by means of the percussion clock 125. If an output data value from the transient memory register 135 is already at the maximum preselected value, then the adder 136 merely transfers this maximum value unaltered to be stored again in the transient memory register 135.

A CONTROL signal is generated by means of the control signal generator in response to each data word addressed out from the transient memory register 135 which has not attained the maximum preselected constant value. This function can be implemented by including a data value comparator in the CONTROL signal generator 140 such that a logic "1" signal is generated if the input data value is less than the preselected constant value.

The present invention can be combined with a variety of tone generators which operate by employing a discrete Fourier-type transform using selected sets of harmonic coefficients. One such tone generator system is described in U.S. Pat. No. 3,809,789 entitled "Computer Organ." This patent is hereby incorporated by reference.

Figure 12:
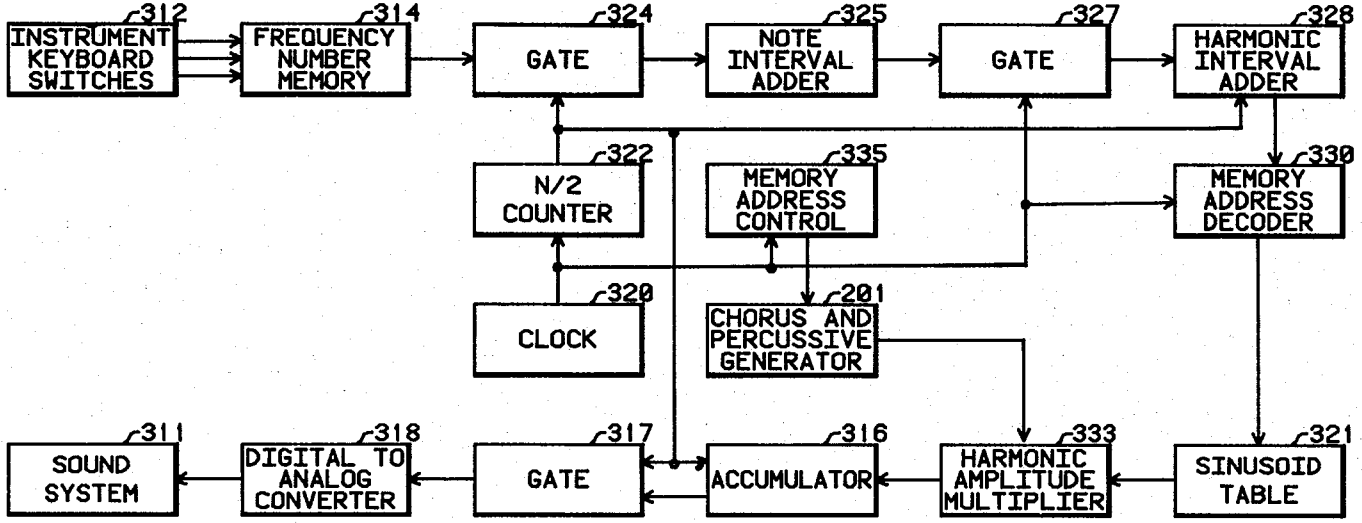
FIG. 12 is a schematic diagram of an alternate embodiment of the invention.

FIG. 12 illustrates a tone generator system which incorporates the present invention into the Computer Organ described in the referenced patent. The system block labeled chorus and percussive generator 201 replaced the block labeled harmonic coefficent memory 15 shown in FIG. 1 of the referenced patent. The system blocks shown in FIG. 12 are numbered to be 300 plus the corresponding block numbers shown in FIG. 1 of the referenced patent.

Figure 13:
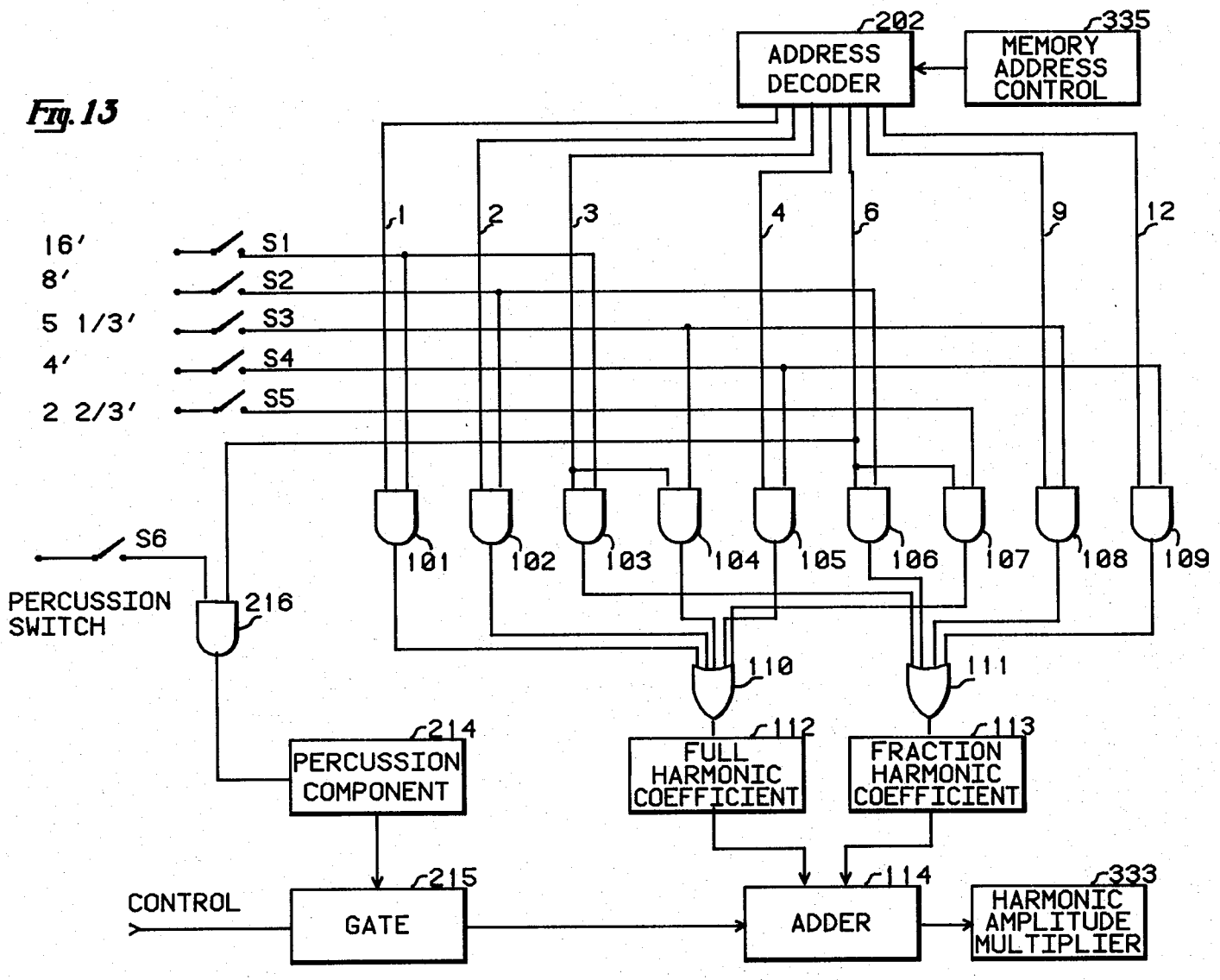
FIG. 13 is a schematic diagram of the chorus and percussive generator 201.

FIG. 13 illustrates the detailed logic of the chorus and percussive generator 201 implemented to include a tibia chorus generator in which each tibia voice comprises a first and a third harmonic component. The contents of the memory address control 335 are decoded in a time sequence onto seven harmonic select signal lines by means of the address decoder 202. Only the harmonic states corresponding to the harmonic number sequence 1,2,3,4,6,9 and 12 are decoded. The remaining harmonics 5,7,8,10,11,13,14 and 16 are ignored and are not decoded since, as discussed previously, they will not contribute to the tibia flute chorus. The remainder of the subsystem logic shown in FIG. 13 operates in a manner previously described for a similar system logic shown in FIG. 8.

A closure of a keyswitch contained in the instrument keyboard switches causes a corresponding frequency number to be accessed out from the frequency number memory 314. The accessed frequency number is added repetitively to the contents of the note interval adder 325. The contents of the note interval adder 325 specifies the sample point at which a waveshape amplitude is calculated. For each sample point, the amplitudes of a number of harmonic components are calculated individually by multiplying harmonic coefficients provided by the chorus and percussive generator by a trigonometric sinusoid value read out from the sinusoid table 321 by the memory address decoder 330. The harmonic component amplitudes are summed algebraically in the accumulator 316 to obtain the net amplitude at a sample point. The sample point amplitudes are converted to an analog signal by means of the digital-to-analog converter 318.

Figure 14:
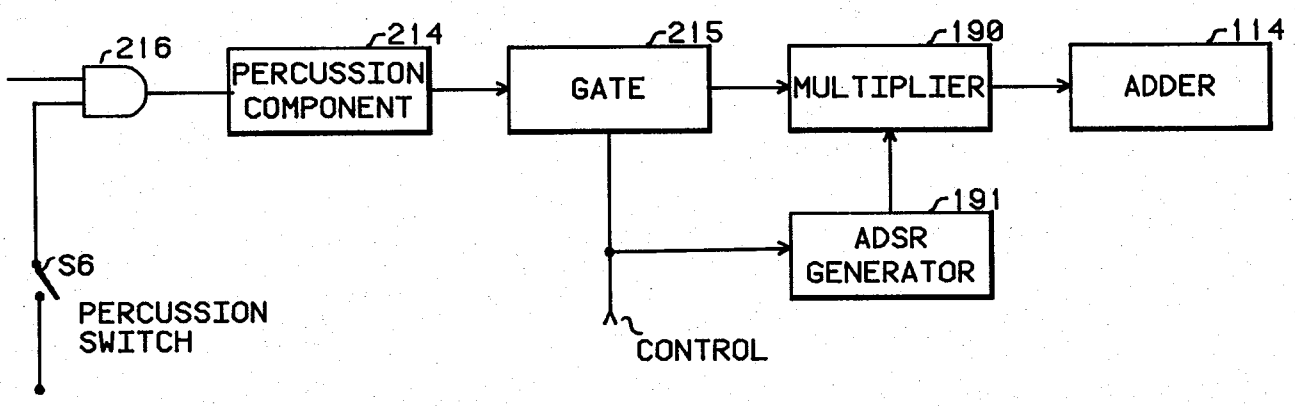
FIG. 14 is a schematic diagram of an ADSR modulator for the percussive voice.

FIG. 14 illustrates an improvement for the percussive voice in which the voice is not added and deleted abruptly. Instead a smooth transition is obtained by modulating the amplitude of the percussion harmonic component read out from the percussion component 214 by a time varying ADSR (attack/decay/sustain/-release) envelope function. The ADSR envelope function is created by the ADSR generator 191 in response to the CONTROL signal. The ADSR envelope function is furnished as one of the input data sources to the multiplier 190. The net result is to create a percussive voice that has its own ADSR envelope variation which is independent of the ADSR envelope variation for the composite tone consisting of the percussive voice and the selected tones.

A suitable ADSR envelope generator is described in U.S. Pat. No. 4,079,650 entitled "ADSR Generator". This patent is hereby incorporated by reference.

I claim:

1. In a keyboard musical instrument having a keyboard containing a plurality of keyswitches and having a number of tone generators, in which a plurality of data words corresponding to the amplitudes of points defining the waveform of a musical tone are computed and transferred sequentially to a digital-to-analog converter to be converted into musical waveshapes, apparatus for producing a transient percussive voice in combination with a preselected musical tone comprising;

a plurality of tone switches, a coefficient memory means for storing a set of harmonic coefficient values, a percussion memory for storing a percussion harmonic coefficient value, a harmonic number generating means whereby a consecutive sequence of harmonic numbers is generated, a first address decoder means responsive to said sequence of harmonic numbers whereby a subsequence of harmonic signals is generated by selecting prespecified ones of said sequence of harmonic signals and wherein said subsequence of harmonic signals is less in number than said sequence of consecutive harmonic numbers, a coefficient select means responsive to the actuation of said plurality of tone switches and responsive to said subsequence of harmonic signals whereby selected harmonic coefficient values from said set of harmonic coefficient values are read out from said coefficient memory means to provide a sequence of selected harmonic coefficient values, a percussion means responsive to a percussion control signal whereby said percussion harmonic coefficient value is read out from said percussion memory in response to a preselected one of said sequence of harmonic signals, an adder means for combining said read out percussion harmonic coefficient value with said sequence of selected harmonic coefficient values to provide a combination sequence of harmonic coefficient values, a main memory means, a means for computing, responsive to said combination sequence of harmonic coefficient values, whereby said plurality of data words corresponding to the amplitudes of points defining a waveform for a period of a musical tone are computed and stored in said main memory means, and a means for producing musical waveshapes from said plurality of data words stored in said main memory means thereby producing said transient percussive voice in combination with a preselected musical tone.

2. A musical instrument according to claim 1 wherein said means for computing comprises;

a main memory means for storing said plurality of data words computed during each computation cycle in a repetitive sequence of computation cycles, a clock for providing timing signals, a word counter for counting said timing signals modulo the number of said plurality of data words stored in said main memory means, a harmonic counter incremented each time said word counter returns to its minimal count state, an adder-accumulator means wherein the count state of said harmonic counter is successively added to the contents of an accumulator in response to said timing signals and wherein the content of said accumulator is initialized to a zero value at the start of each said computation cycle, a sinusoid table for storing a plurality of trigonometric sinusoid values, a second address decoder means responsive to the content of said accumulator in said adder-accumulator means for reading out trigonometric sinusoid values from said sinusoid table, a multiplier means for multiplying the trigonometric sinusoid values read out from said sinusoid table by said combination sequence of harmonic coefficient values, and a means for successively summing the output from said multiplier means with values read out from said main memory means in response to the count state of said word counter means and whereby the summed values are stored in said main memory means.

3. A musical instrument according to claim 2 wherein said first address decoder means comprises;

a decoding circuitry means responsive to preselected count states of said harmonic counter whereby a sequence of harmonic signals are generated on a plurality of harmonic select signal lines.

4. A musical instrument according to claim 3 wherein said coefficient select means comprises;

a harmonic select means responsive to the actuation states of said plurality of tone switches whereby said sequence of harmonic coefficient select signals are generated in response to harmonic signals generated on said plurality of harmonic select signal lines, and a coefficient addressing means responsive to said sequence of harmonic coefficient select signals whereby corresponding harmonic coefficient values are read out from said coefficient memory means and provided to said means for computing.

5. A musical instrument according to claim 1 wherein said percussion means comprises;

a detection means for scanning said plurality of keyswitches in a sequence of keyswitch scans wherein a detection signal is generated for each actuated keyswitch, a switch state generator responsive to said detection signal whereby an initial signal is generated if said detection signal is generated on one of said sequence of keyswitch scans and was not generated on an immediate prior keyswitch scan corresponding to the same keyswitch, a percussion clock for providing percussion timing signals, a percussion counter for counting said percussion timing signals modulo a preselected constant number and wherein a reset signal is generated when said percussion counter is incremented to its minimal count state, a percussion gate interposed between said percussion clock and said percussion counter whereby said percussion timing signals are provided to said percussion counter in response to said initial signal, and a percussion control signal generator wherein said percussion control signal is generated in response to said initial signal and wherein in response to said reset signal said percussion control signal is not generated.

6. In a keyboard musical instrument having a keyboard containing a plurality of keyswitches and having a number of tone generators, in which a plurality of data words corresponding to the amplitudes of points defining the waveform of a musical tone are computed and transferred sequentially to a digital-to-analog converter to be converted into musical waveshapes, apparatus for producing a transient percussive voice in combination with a preselected musical tone comprising;

a plurality of tone switches, a coefficient memory means for storing a set of harmonic coefficient values, a percussion memory for storing a percussion harmonic coefficient value, a harmonic number generating means whereby a sequence of consecutive harmonic numbers is generated, a first address decoder means responsive to said sequence of harmonic numbers whereby a subsequence of harmonic signals is generated by selecting prespecified ones of said sequence of harmonic signals and wherein said subsequence of harmonic signals is less in number than said sequence of consecutive harmonic numbers, a coefficient select means responsive to the actuation of said plurality of tone switches and responsive to said subsequence of harmonic signals whereby selected harmonic coefficient values from said set of harmonic coefficient values are read out from said coefficient memory means to provide a sequence of selected harmonic coefficient values, a detection means for scanning said plurality of keyswitches in a sequence of keyswitch scans wherein a detection signal is generated for each actuated keyswitch, a switch state generator responsive to said detection signal whereby an initial signal is generated if said detection signal is generated on one of said sequence of keyswitch scans and was not generated on an immediate prior keyswitch scan corresponding to the same keyswitch, an assignor means whereby one of said number of tone generators is assigned in response to said detection signal and comprising an assignment memory for storing a plurality of assignment data values each of which is indicative of an assigned or nonassigned status of one of said number of tone generators, a percussion clock for providing percussion timing signals, a percussion counter for counting said percussion timing signals modulo a preselected constant number and wherein a reset signal is generated when said percussion counter is incremented to its minimal count state, a start signal generator responsive to said initial signal and responsive to said plurality of assignment data values wherein a start signal is generated if no more than one of said plurality of assigned data values is indicative of an assigned status of said number of tone generators, a percussion signal generator wherein a percussion control signal is generated in response to said start signal and said percussion control signal generation is terminated in response to said reset signal, a memory reading means responsive to said percussion control signal whereby said percussion harmonic coefficient value is read from said percussion memory in response to a preselected one of said sequence of harmonic signals, an adder means for combining said read out percussion harmonic coefficient value with said sequence of selected harmonic coefficient values to provide a combination sequence of harmonic coefficient values, a main memory means, a means for computing, responsive to said combination sequence of harmonic coefficient values, whereby said plurality of data words corresponding to the amplitudes of points defining a waveform for a period of a musical tone are computed and stored in said main memory means, and a means for producing musical waveshapes from said plurality of data words stored in said main memory means thereby producing said transient percussive voice in combination with a preselected musical tone.

7. A musical instrument according to claim 6 wherein said percussion means comprises;

an envelope signal generator wherein an envelope signal is generated in response to said percussion control signal, and a multiplication means interposed between said percussion memory and said adder means whereby said read out percussion coefficient value is multiplied by said envelope signal.

8. In a keyboard musical instrument having a keyboard containing a plurality of keyswitches in which a plurality of data words are computed at regular time intervals, corresponding to the combination of a number of tone generators, and are converted into musical waveshapes, apparatus for producing a transient percussive voice in combination with a preselected musical tone comprising;

a plurality of tone switches, a coefficient memory means for storing a set of harmonic coefficient values, a percussion memory for storing a percussion harmonic coefficient value, a harmonic number generating means whereby a sequence of consecutive harmonic numbers is generated, a first address decoder means responsive to said sequence of harmonic numbers whereby a subsequence of harmonic signals is generated by selecting prespecified ones of said sequence of harmonic signals and wherein said subsequence of harmonic signals is less in number than the number of said sequence of consecutive harmonic numbers, a coefficient select means responsive to the actuation of said plurality of tone switches and responsive to said sequence of harmonic signals whereby selected harmonic coefficient values from said set of harmonic coefficient values are read out from said coefficient memory means to provide a sequence of selected harmonic coefficient values, a percussion means responsive to a percussion control signal whereby said percussion harmonic coefficient value is read out from said percussion memory in response to a preselected one of said sequence of harmonic signals, an adder means for combining said read out percussion coefficient value with said sequence of selected harmonic coefficient values to provide a combination sequence of harmonic coefficient values, a computing means responsive to said sequence of harmonic coefficient values for computing a sequence of data words at regular time intervals wherein each said data word corresponds to a combination of a number of tone generators, and a means for producing musical waveshapes from said sequence of data words thereby producing said transient percussive voice in combination with a preselected musical tone.

9. A musical instrument according to claim 8 wherein said computing means comprises;

a means for obtaining a frequency number, a note interval adder wherein said frequency number is successively added to the sum previously contained in said note interval adder, a harmonic interval adder cleared before each computation of one of said sequence of data words wherein the content of said note interval adder is added to the contents previously in said harmonic interval adder, a sinusoid table for storing a plurality of trigonometric sinusoid values, a second address decoder means responsive to the contents of said harmonic interval adder for reading out trigonometric sinusoid values from said sinusoid table, a multiplier means for multiplying the trigonometric sinusoid values read out from said sinusoid table by harmonic coefficient values provided by said coefficient select means, and a means for successively summing the output from said multiplier means thereby producing each one of said sequence of data words.

10. In a keyboard musical instrument having a keyboard containing a plurality of keyswitches in which a plurality of data words are computed at regular time intervals, corresponding to the combination of a number of tone generators, and are converted into musical waveshapes, apparatus for producing a transient percussive voice in combination with a preselected musical tone comprising;

a plurality of tone switches, a coefficient memory means for storing a set of harmonic coefficient values, a percussion memory for storing a percussion harmonic coefficient value, a harmonic number generating means whereby a sequence of consecutive harmonic numbers is generated, a first address decoder means responsive to said sequence of harmonic numbers whereby a subsequence of harmonic signals is generated by selecting prespecified ones of said sequence of harmonic signals and wherein said subsequence of harmonic signals is less in number than the number of said sequence of consecutive harmonic numbers, a detection means for scanning said plurality of keyswitches in a sequence of keyswitch scans wherein a detection signal is generated for each actuated keyswitch, a switch state generator responsive to said detection signal whereby an initial signal is generated if said detection signal is generated on one of said sequence of keyswitch scans and was not generated on an immediate prior keyswitch scan corresponding to the same keyswitch, an assignor means comprising an assignment memory whereby an assignment data value is stored corresponding to each keyswitch for which said initial signal is generated, a percussion clock for providing percussion timing signals, a percussion counter for counting said percussion timing signals modulo a preselected constant number and wherein a reset signal is generated when said percussion counter is incremented to its initial count state, a start signal generator responsive to said initial signal and responsive to the data stored in said assignment memory wherein a start signal is generated if no more than one of said stored data values is indicative of an actuated keyboard switch, a percussion signal generator wherein a percussion control signal is generated in response to said start signal and said percussion control signal generation is terminated in response to said reset signal, a memory reading means responsive to said percussion control signal whereby said percussion harmonic coefficient value is read from said percussion memory in response to a preselected one of said sequence of harmonic signals, an adder means for combining said read out percussion harmonic coefficient value with said sequence of selected harmonic coefficient values to provide a combination sequence of harmonic coefficient values, a computing means responsive to said sequence of harmonic coefficient values for computing a sequence of data words at regular time intervals wherein each said data word corresponds to a combination of a number of tone generators, and a means for producing musical waveshapes from said plurality of data words thereby producing said transient percussive voice in combination with a preselected musical tone.

11. A musical instrument according to claim 8 wherein said percussion means comprises;

an envelope signal generator wherein an envelope signal is generated in response to said percussion control signal, and a multiplication means interposed between said percussion memory and said adder means whereby said read out percussion coefficient value is multiplied by said envelope signal.

* * * * *